US009095197B2

(12) United States Patent
Rizzuto et al.

(10) Patent No.: US 9,095,197 B2
(45) Date of Patent: Aug. 4, 2015

(54) APPLIANCE HOLDER

(71) Applicants: Francesco Rizzuto, Calgary (CA); Donna Marie Rizzuto, Calgary (CA); Dale Marshall, Calgary (CA); Imre Ordog, Calgary (CA)

(72) Inventors: Francesco Rizzuto, Calgary (CA); Donna Marie Rizzuto, Calgary (CA); Dale Marshall, Calgary (CA); Imre Ordog, Calgary (CA)

( * ) Notice: Subject to any disclaimer, the term of this patent is extended or adjusted under 35 U.S.C. 154(b) by 0 days.

(21) Appl. No.: 14/090,767

(22) Filed: Nov. 26, 2013

(65) Prior Publication Data

US 2014/0145045 A1 May 29, 2014

(30) Foreign Application Priority Data

Nov. 26, 2012 (CA) ..... 2796537

(51) Int. Cl.
*F16M 11/00* (2006.01)
*A45D 1/20* (2006.01)

(52) U.S. Cl.
CPC ..... *A45D 1/20* (2013.01)

(58) Field of Classification Search
CPC ..... A45D 1/20
USPC ..... 248/176.2, 117.1, 117.3, 346.01, 248/346.03, 311.2, 346.5; 211/13, 74
See application file for complete search history.

(56) References Cited

U.S. PATENT DOCUMENTS

| | | | | |
|---|---|---|---|---|
| 3,705,680 | A * | 12/1972 | Siegel | 228/57 |
| 4,103,145 | A * | 7/1978 | Oliveri | 219/222 |
| 5,031,778 | A * | 7/1991 | Edgecombe | 211/26 |
| 5,090,649 | A * | 2/1992 | Tipp | 248/176.2 |
| 5,615,782 | A | 4/1997 | Choe | |
| 6,109,446 | A * | 8/2000 | Foote | 206/759 |
| 7,232,039 | B2 * | 6/2007 | Doran | 220/23.88 |
| D670,865 | S * | 11/2012 | Cooper et al. | D28/73 |
| 8,348,582 | B2 * | 1/2013 | Bithell et al. | 411/513 |
| 8,689,999 | B2 * | 4/2014 | Cooper et al. | 220/507 |
| 8,810,076 | B2 * | 8/2014 | Levi | 307/139 |
| 8,851,304 | B2 * | 10/2014 | Alexander | 211/60.1 |
| 2005/0284556 | A1 * | 12/2005 | Sandstrom | 152/510 |

FOREIGN PATENT DOCUMENTS

| | | |
|---|---|---|
| CA | 2752224 | 8/2012 |
| CN | 201398615 | 2/2010 |

OTHER PUBLICATIONS

Office Action issued Jan. 15, 2015 in corresponding Canadian Patent Application No. 2835571.

* cited by examiner

*Primary Examiner* — Amy Sterling
(74) *Attorney, Agent, or Firm* — Erickson Kernell Derusseau & Kleypas, LLC

(57) ABSTRACT

A holder for a hair appliance with heatable elements that is comprised of a stand with two pockets. The heated portion of the appliance is inserted into the two pockets, each pocket receiving a heatable element of the appliance. The pockets are made of heat resistant material. The use of the dual-pockets keeps the heating elements of the appliance separated, which assists in cooling and helps extend the life of the appliance. The base includes a counterweight to balance the holder.

14 Claims, 6 Drawing Sheets

18
14a
48
47
12
16

40
54a
50
52
74
88
43
65
80
60
78
82a 14a
18
26
25
20
24
47
14b
57
59
67
76
63
70
89
90

40
24
26
C
20
12
43
90
89
60

APPLIANCE HOLDER

CROSS-REFERENCE TO RELATED APPLICATIONS

This application claims priority under 35 U.S.C. §119 from Canadian Application No. 2,796,537 filed Nov. 26, 2012.

FIELD OF THE INVENTION

The present invention is related to storage and support devices for handheld implements having electrically heated elements, and, more particularly to a holder for a hair straightener, flat iron, crimping iron or the like.

BACKGROUND OF THE INVENTION

Tools and appliances with heated elements are used for various tasks and applications. Some home health and beauty appliances, such as hair straighteners, flat irons, and crimping irons have opposing heating elements for use to treat hair pressed between them. During and after their use, these appliances are often placed directly on a countertop, sink, tub or cabinet. As a result there is a risk that the appliance could damage the surface it's placed on. Moreover, injury can result if the heating elements are touched inadvertently. If placed precariously, the appliance can fall to the floor or even into the water, posing additional hazards.

The heatable elements on a hair straightener or the like will heat to temperatures of 200° C. or greater in order to properly function. To avoid damage to counter surfaces and the like the appliance must be carefully placed in the right attitude or the heating elements will contact the counter surface. There may also be a fire hazard should the heated elements come into contact with flammable materials such as tissue or clothing. Hair appliances with heated elements can also pose a danger to children and pets. Typically they lack any warning light or signals that they are hot.

Heated hair appliances also pose similar dangers in salons, barbershops and other workplaces where they are used. Customers may inadvertently touch or knock them over. There is a danger that the busy professional using the appliance might forget that it is hot.

Hair appliances are cooled by exposure to ambient air. As a result, the appliance is exposed for a significant amount of time often unattended while it cools sufficiently so that it can be safely stored away. This is a significant safety drawback for adults or children who might encounter the appliance while its still hot.

It is desirable therefore to have a holder that will safely retain the heated appliance during and after its use while it is still too hot to be safely handled or stored. It is also desirable to have a holder that will not be damaged by the heated elements of the appliance. Moreover, it is desirable to separate the heating elements when the appliance is hot. If the heating elements are kept too close to one another, they can be damaged and the life of the appliance reduced. Further, It is desirable to have a holder that is capable of receiving different sized and shaped appliances.

From an aesthetic and convenience standpoint it is preferable that the hair appliance be neatly and easily insertable into the holder.

There are a number of prior approaches to creating a holder for a hair appliance. However, all of these previous attempts have a single pocket. The result is that the two heating elements of the appliance are held in close proximity to one another when the appliance is placed in the holder. The closeness of the heating elements can damage them and can actually increase the amount of time it takes for the appliance to cool down after use.

What is needed therefore is a holder for heated hair and other appliances that safely and conveniently holds the appliance and that also physically separates the elements to better preserve them and facilitate cooling.

SUMMARY OF THE INVENTION

In view of the foregoing, there is a need for a device of simple design for conveniently holding and storing a hair straightener or like appliance with heating elements that keeps the heated elements separated for better cooling and ideally prolongs the life of the elements. Accordingly, the present invention has been developed to provide a holder for appliances with heated elements with separate pockets for each element.

In a preferred embodiment of the present invention, there is a holder for heated appliances. The holder includes two pockets, a stand, and a base. A heated appliance may be disposed within the two pockets with each pocket receiving a heating element. The two pockets may be contained within a stand that holds the pockets at a desired angle. Alternatively the pockets may be contained in an insert that may be removably connectable to the stand. The two pockets may keep the heating elements separated. The two pockets may be made from or lined with a heat resistant material.

The two pockets will have a space between them that allows for air to flow between the pockets. Allowing air to flow freely between the pockets and into the pockets decreases the time it takes for the heating elements to cool.

The stand may be attached to or formed with a base with a counterweight; the base stabilizes the holder, preventing it from falling or sliding. The base may be comprised of a non-stick material or further include rubber non-skid feet.

If the holder has a removable insert defining the pockets, the stand may have an opening to receive the insert. Different inserts may be removably inserted into the stand, the inserts having differently shaped and/or sized pockets if desired for differently shaped or sized appliances. The inserts might define a single pocket, or more than two pockets for use with tools or appliances having in excess of two heating elements.

The stand may orient the pockets at an angle relative to the base allowing the appliance to be more easily inserted or removed from the holder.

BRIEF DESCRIPTION OF THE DRAWINGS

Preferred embodiments of the present invention will now be described in greater detail and will be better understood when read in conjunction with the following drawings in which.

DETAILED DESCRIPTION OF THE INVENTION

The following description is directed to a holder 1 for a tool or appliance having heating elements, in this case a hair straightener. The reference to a hair straightener is merely exemplary however. Holder 1 can be used for other hair appliances as well such as crimping irons, flat irons or indeed any other non-hair or personal grooming tools or appliances that use heated elements.

Figure 1:
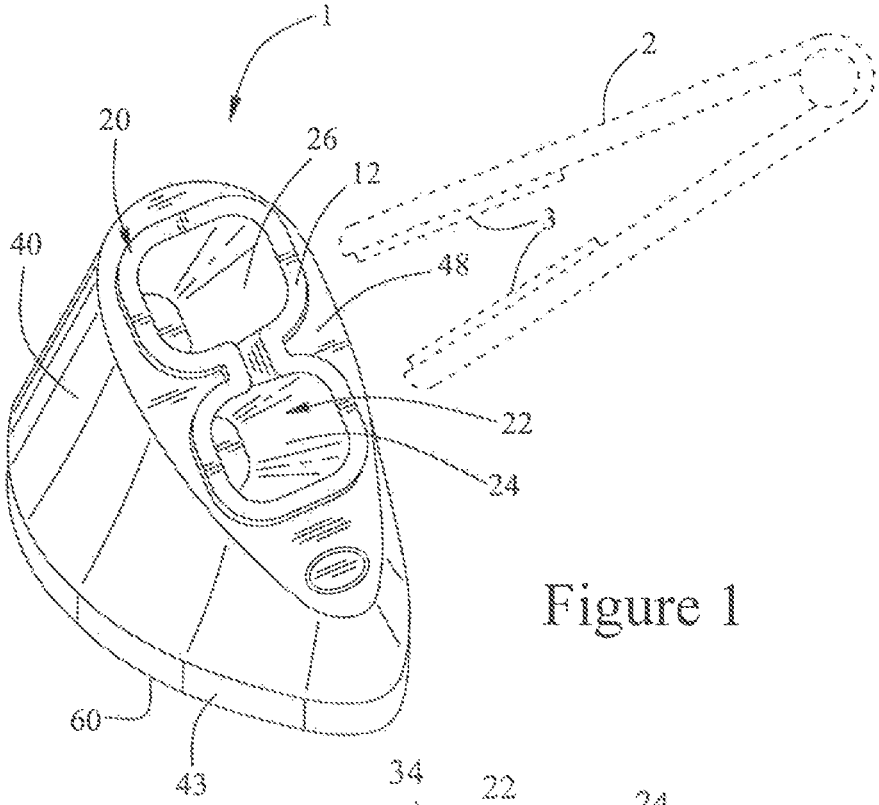
FIG. 1 is a perspective view of one embodiment of the holder of the present invention.
Figure 2:
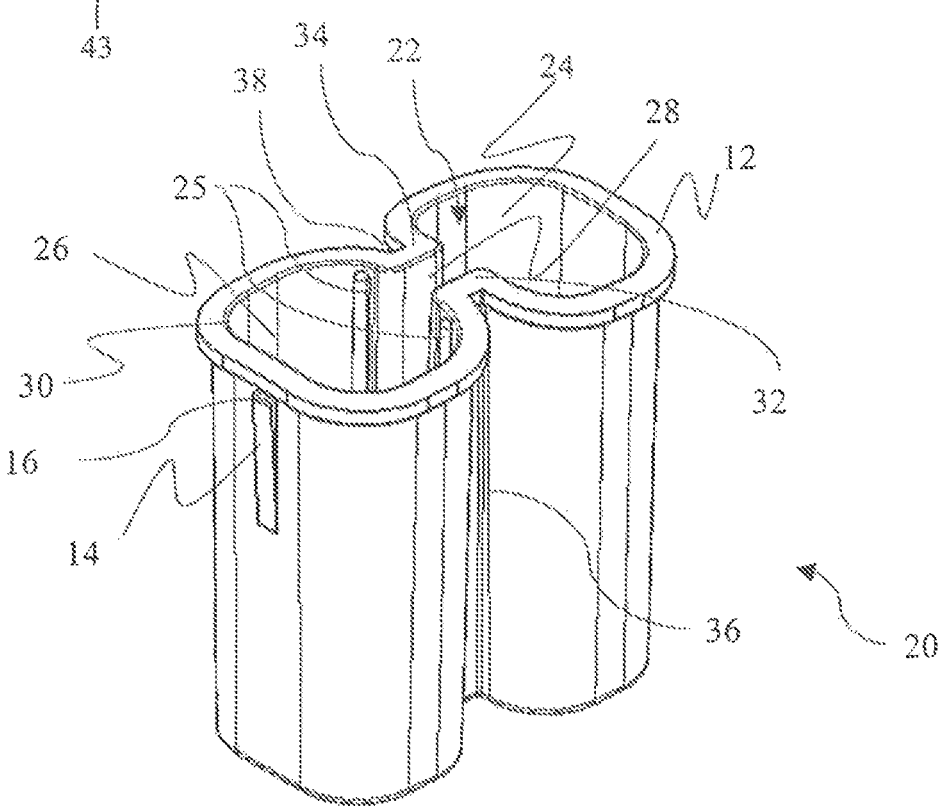
FIG. 2 is a perspective view of an insert for use with the holder shown in FIG. 1.
Figure 3:
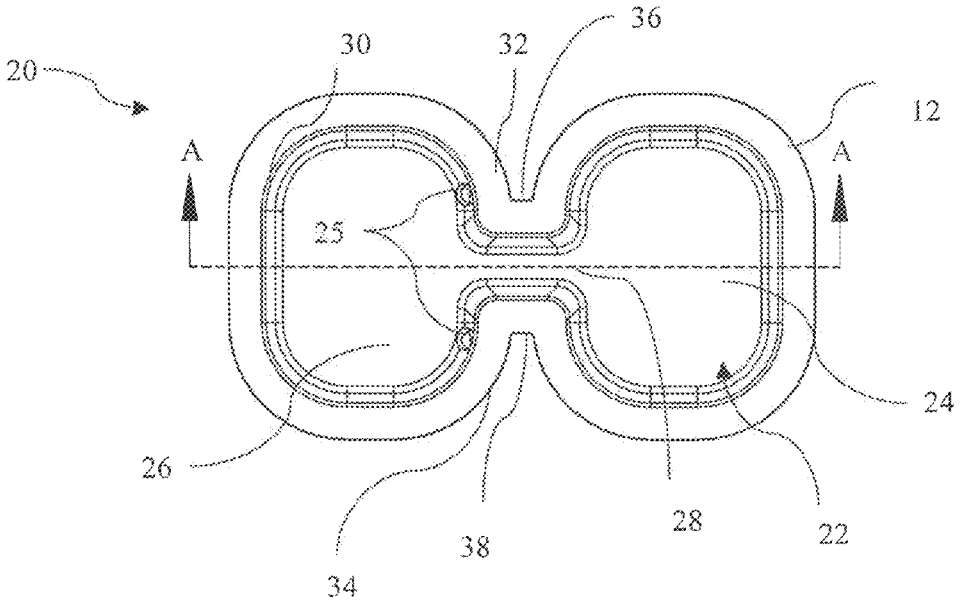
FIG. 3 is a top plan view of the insert of FIG. 2.
Figure 4:
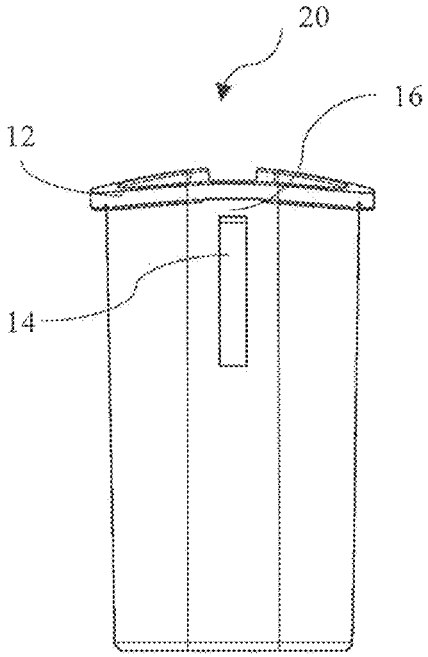
FIG. 4 is an end elevational view of the insert of FIG. 2.
Figure 5:
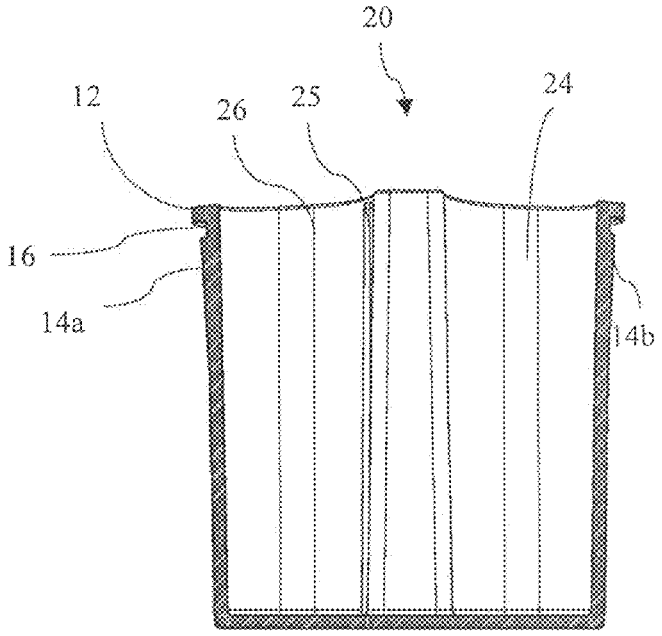
FIG. 5 is cross-sectional view of the insert along section line A-A appearing in FIG. 3.
Figure 6:
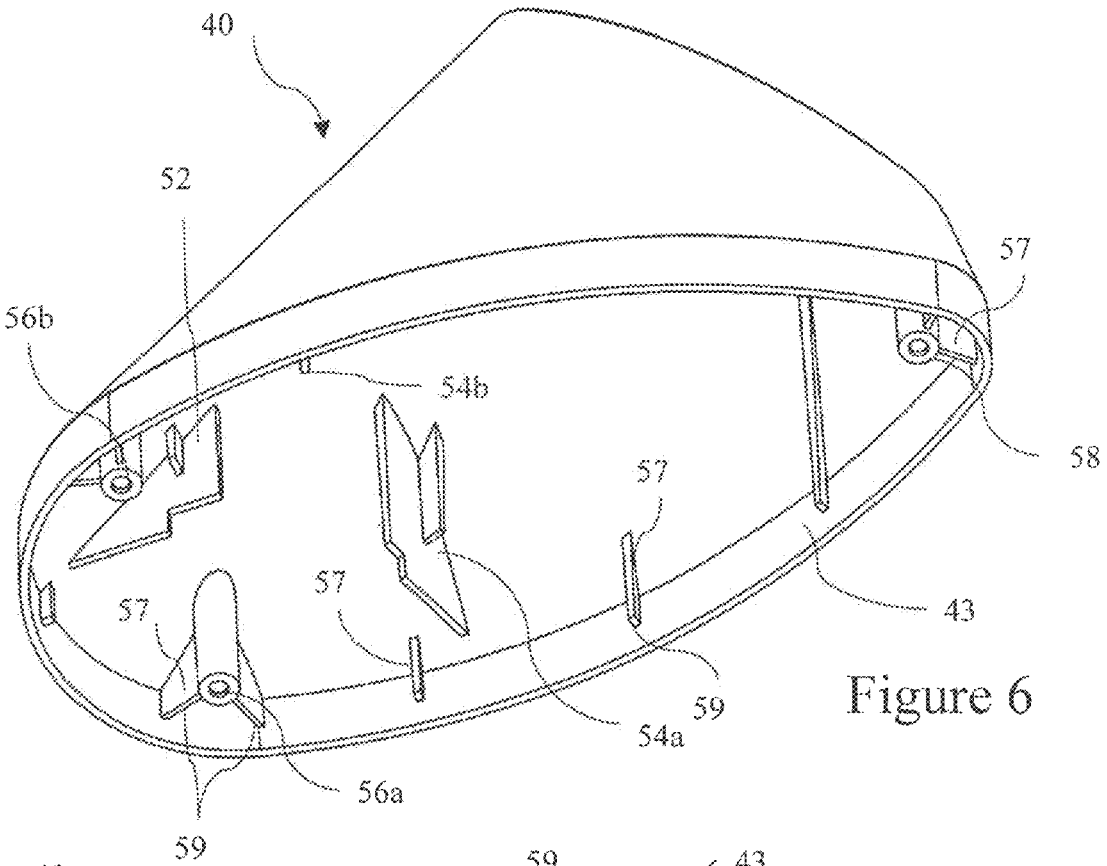
FIG. 6 is a bottom perspective view of one embodiment of a stand for the holder.
Figure 7:
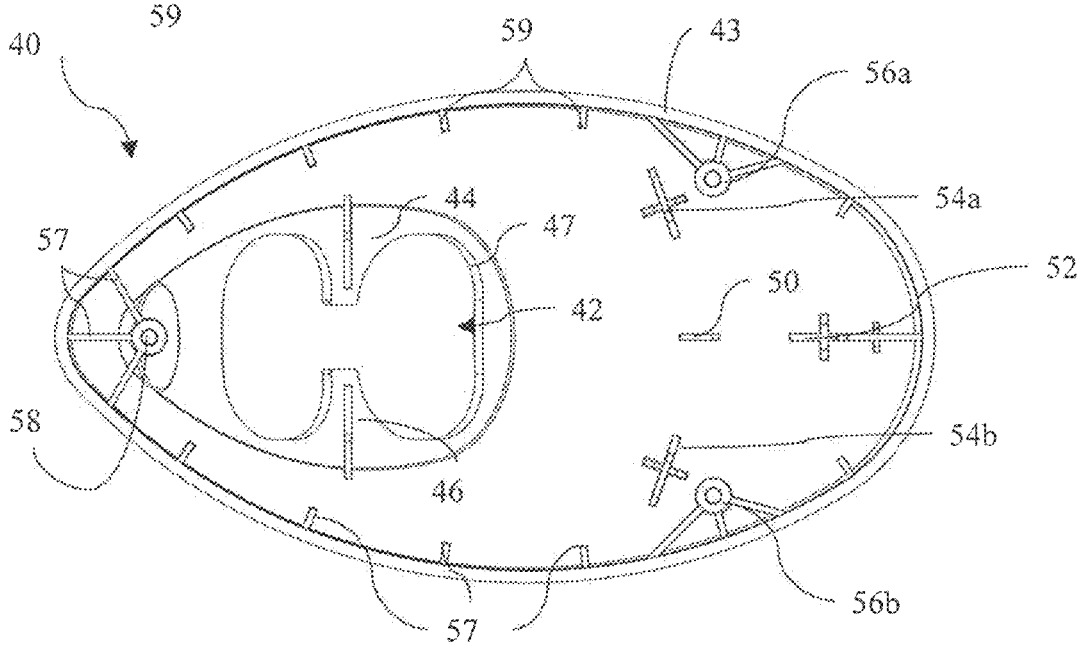
FIG. 7 is a bottom plan view of the stand of FIG. 6.
Figure 8:
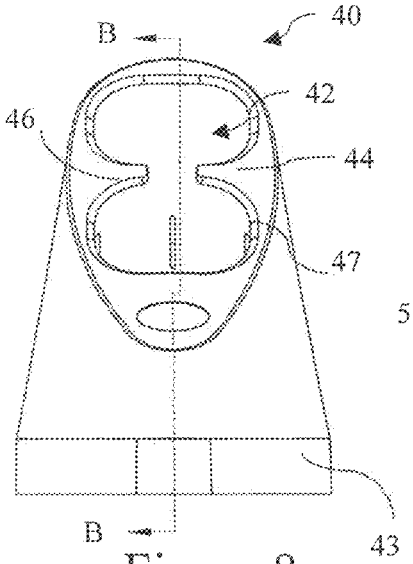
FIG. 8 is a front elevational view of the stand of FIG. 6.
Figure 9:
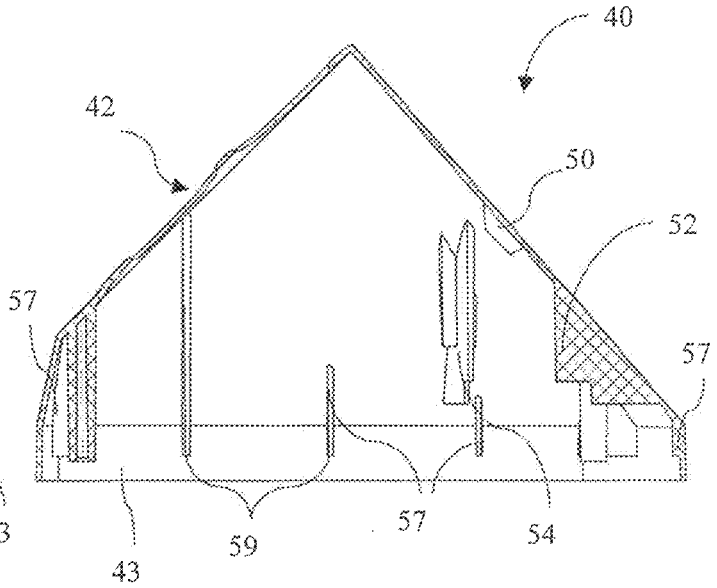
FIG. 9 is a cross sectional view of the stand along section line B-B appearing in FIG. 7.

FIG. 1 illustrates one embodiment of the holder 1 of the present invention. The holder 1 may include an insert 20, a stand 40 and a base 60. Insert 20 may be removably inserted into stand 40. Stand 40 may be attached to base 60. Alternatively, holder 1 and insert 20 may be formed as a single molded piece.

Figures 12, 13, 13A, 13B:
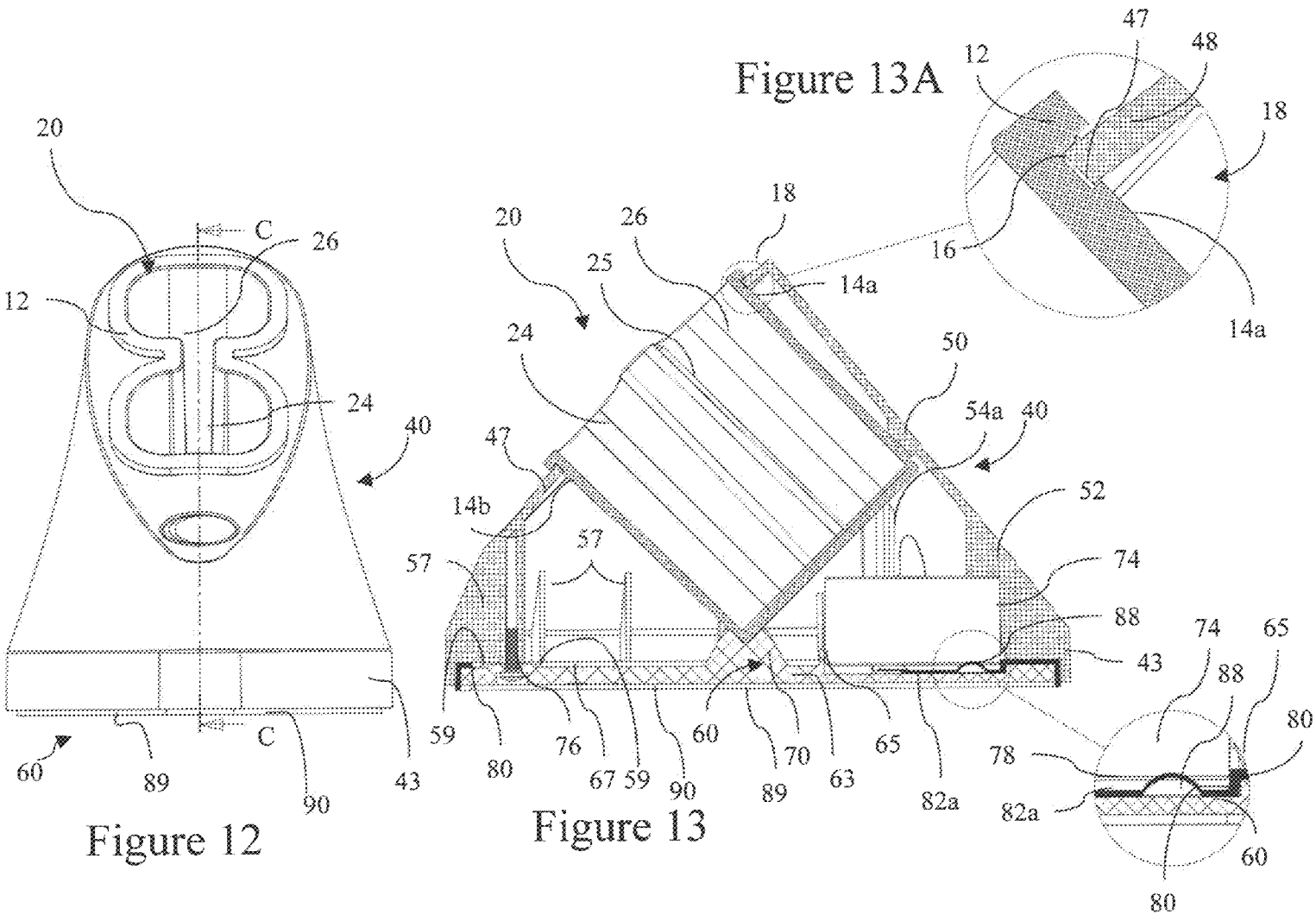
FIG. 12 is a front elevational view of one embodiment of the holder in an assembled condition.
FIG. 13 is a cross sectional view of the holder along section line C-C appearing in FIG. 12.
FIG. 13A is an enlarged cross sectional view of a clip forming part of the holder.
FIG. 13B is an enlarged cross sectional view of a counterweight positioned in the holder.

FIGS. 2-5 illustrate an embodiment of insert 20. Insert 20 may be generally rectangular in shape with an opening 22 at one end. The interior of insert 20 preferably has two pockets 24, 26, which are formed by having the insert's sidewalls crimp inwardly at 32 and 34. Preferably crimps 32, 34 leave a gap or an open space 28 between them in the interior of insert 20. Gap 28 allows for airflow between the two pockets 24, 26. Preferably as well, pocket 26, which will be the upper pocket when insert 20 is inserted into stand 40 as shown in FIGS. 1 and 13, is formed with a pair of spaced apart vertically extending ribs 25, one on each side of gap 28. Each rib 25 extends vertically from at or near the top of pocket 26 to at or near its bottom. A hair appliance, such as a straightener 2, can be inserted into the two pockets 24, 26; each pocket receiving a respective arm of the straightener and the heating element 3 thereon. The airflow in and between pockets 24, 26 assists in cooling the heating elements of the hair straightener. The heating element of the straightener inserted into pocket 26 is held off from the pocket's interior surfaces on either side of gap 28 by ribs 25, which helps avoid excessive conductive heat transfer to the interior surfaces which could cause damage over time. The ribs also maintain a gap between the heating element and the pocket's inner surfaces for better air flow and cooling.

In a preferred embodiment, crimps 32, 34 of insert 20 define receiving grooves 36, 38 on the exterior of insert 20. Receiving grooves 36, 38 will be engaged with stand 40 as will be discussed in more detail below.

Pockets 24, 26 of insert 20 are preferably lined with, or made from, a thermally resistant material 30 to prevent damage from exposure to the straightener's heating elements. For example in one embodiment the pockets, and the entire insert 20, may be formed from a glass filled nylon such as Dupont's™ Zytel™ plastic. Preferably the pocket has a heat deflection of approximately 500° F. A person skilled in the art will recognize that other materials may be suitable as well. The pockets can be universally shaped and sized to receive the arms of pretty much any tool or appliance or they can be adapted to the shape and size of specific tools or appliances. In a preferred embodiment, each pocket 24, 26 tapers slightly inwardly from top to bottom as seen most clearly in FIGS. 5 and 13, from about 42 by 28 mm at the opening of each pocket to about 29 by 26 mm at its bottom. Each pocket is approximately 80 mm deep. Pockets this size should receive the ends of most straighteners and other appliances to a sufficient depth to fully or at least substantially enclose the heating elements thereon and with enough surrounding air space for good convective cooling. Pockets of this size and depth should also prevent the straightener from overbalancing holder 1.

Insert 20 is formed with a radially outwardly extending peripheral flange 12. When insert 20 is inserted into stand 40, flange 12 will rest against stand 40's outer surface 48 as seen most clearly in FIGS. 12 and 13. Insert 20 can also have at least one wedge-shaped flange 14*a*, 14*b* at each of its ends. The width of flange 14*a* may be slightly larger than the width of flange 14*b* for unidirectional insertion of insert 20 into stand 60 as will be described below. Each of the wedges ends short of radial flange 12 to define a slot 16 between wedge 14*a*, 14*b* and radial flange 12. Slot 16 may function as part of a clip 18 as shown in FIG. 13A to attach insert 20 to stand 40 as will be described below.

If ribs 25 are formed in pocket 26 only, it's preferred that insert 20 fit unidirectionally into stand 40. This can be accomplished in a number of different ways that will occur to those skilled in the art. For example, the pockets can be differently sized or shaped to fit only one way into opening 42 in stand 40. Another method is to size wedges 14*a* and 14*b* differently so that insert 20 will only fit into opening 42 with pocket 26 on the high side.

FIGS. 6-9 illustrate an embodiment of stand 40. Stand 40 may be generally triangular in cross-sectional shape although rounded at its ends, with an opening 42 sized and shaped to receive insert 20 at a preferred angle from the vertical to facilitate removal and insertion of the appliance. Opening 42 may include two extending members 44, 46 that will engage with receiving grooves 36, 38 of insert 20. The inner peripheral wall 47 of opening 42 is preferably tapered. The tapered wall 47 of opening 42 may act as part of clip 18 to secure insert 20 to stand 40 as will be discussed in greater detail below.

Stand 40 is formed with a shoulder 50 that stabilizes insert 20 as will be discussed in greater detail below. Stand 40 may also include several brackets 52, 54*a*, 54*b* that will secure a counterweight 74 in the assembled holder. The stand may also include several threaded holes or bushings 56*a*, 56*b* and 58 for threaded fasteners used to attach base 60 and stand 40 together. The lower end of stand 40 is defined by a more vertically orientated peripherally extending skirt 43.

Stand 40 additionally and preferably also includes some circumferentially spaced apart ribs 57 for general stiffening and reinforcement. Ribs 57 will typically span the transition from the tapering upper walls of stand 40 to the more vertical skirt 43 and have lower edges 59 that will help locate base 60 when connected to sand 40.

Figure 10:
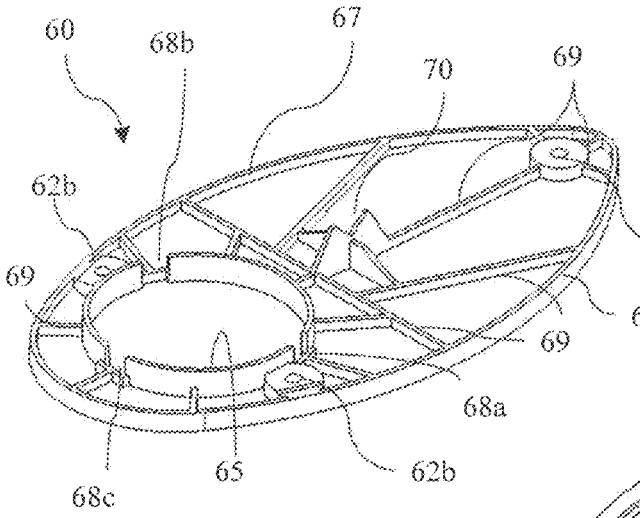
FIG. 10 is an upper perspective view of one embodiment of a base for the holder of the present invention.

FIG. 10 illustrates an embodiment of base 60. Base 60 is preferably the same shape as the bottom of stand 40 to fit concentrically inside of skirt 43. Base 60 may include multiple holes 62*a*, 62*b* and 64 that receive fasteners such as threaded screws 76 to connect base 60 to stand 40. When stand 40 is placed on base 60, holes 62*a*, 62*b* and 64 on the base should align with the threaded holes 56*a*, 56*b* and 58 of stand 40.

Figure 11:
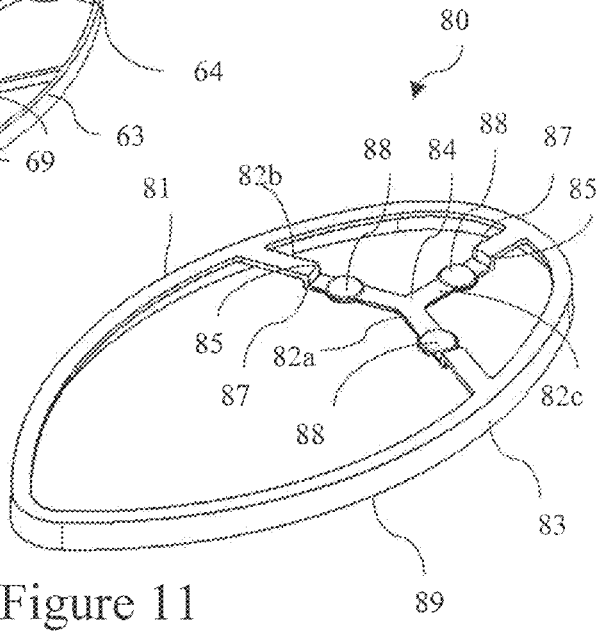
FIG. 11 is an upper perspective view of one embodiment of a gasket for the holder of the present invention.

Base 60 preferably and additionally includes or is formed with a counterweight support 65 that co-operates with a gasket 80 seen most clearly in FIG. 11 to secure counterweight 74. Ideally the shape of support 65 corresponds to the shape of the counterweight so that if the counterweight is cylindrical for example, support 65 is circular or ring shaped to receive the counterweight's lower end. Notches 68*a*, 68*b* and 68*c* are formed into support 65 as shown most clearly in FIG. 10 to receive and mate with counterweight support arms 82*a*, 82*b* and 82*c* of gasket 80. Notches 68*a*, 68*b* and 68*c* are preferably separated at 120° intervals.

Base 60 may further include a bracket 70 that will support the lower corner of insert 20 when holder 1 is assembled as seen most clearly in FIG. 13. Bracket 70 helps stabilize insert 20, preventing it from wobbling or moving unnecessarily.

Base 60 is completed with a peripheral wall 63 and an array of stiffening and reinforcing ribs 69 such as those shown in FIG. 10. When base 60 is connected to stand 40, the upper edge 67 of peripheral wall 63 squeezes flange 81 of gasket 80 against the lower edges 59 of stiffening ribs 57 of stand 40.

FIG. 11 illustrates an embodiment of gasket 80, which may be secured between base 60 and stand 40. Gasket 80 may serve to secure counterweight 74 within stand 40, as will now be discussed.

In one embodiment, gasket 80 may have an inwardly extending peripheral flange 81 and a downwardly extending outer peripheral wall 83. Wall 83 of gasket 80 is shaped and sized to fit closely concentrically inside skirt 43 of stand 40. The peripheral wall 63 of base 60 is shaped and sized to fit closely concentrically inside gasket's 80's peripheral wall 83. In the assembled holder 1 therefore, base 60 when connected to stand 40, presses flange 81 against the lower edges of ribs 57 thereby securing gasket 80 to stand 40. Moreover, the height of gasket sidewall 83 exceeds the height of base skirt 43 so that in their assembled condition, the gasket's lower edge 89 extends below the base's lower edge to form a grippy and resiliently compliant footing 90 on which holder 1 rests on a supporting surface.

In one embodiment, gasket 80 includes three arms 82*a*, 82*b* and 82*c* extending radially inwardly from flange 81 of gasket 80 and connecting centrally at a single point 84. Each arm 82*a*, 82*b* and 82*c* is crooked at 85 to define a shoulder 87 to locate and bracket counterweight's 74's lower end in co-operation with support 65 as seen most clearly in FIG. 13.

Additionally, each arm 82*a*, 82*b*, 82*c* may include a button or bubble 88 intermediate of shoulders 87 and point 84. Accordingly, whereas support 65 and shoulders 87 retain the counterweight from moving from side to side, bubbles 88 bias counterweight 74 against brackets 52, 54*a* and 54*b* to restrain the weight from rattling up and down after base 60 is connected to stand 40. Bubbles 88 also compensate for dimensional intolerances in the height of counterweight 74.

Gasket 80 is preferably comprised of a soft, high friction material that has a durometer reading of 55 or thereabouts on the Shore A hardness scale. An ideal material is Santoprene™. However, it will be apparent to a person skilled in the art that other materials will be suitable. The soft material allows footing 90 to be compressed slightly when in contact with the underlying support surface, which allows assembled holder 1 to absorb side to side forces without tipping or becoming unstable. Further footing 90 also provides friction against the support surface to prevent holder 1 from slipping or sliding.

Figure 14:
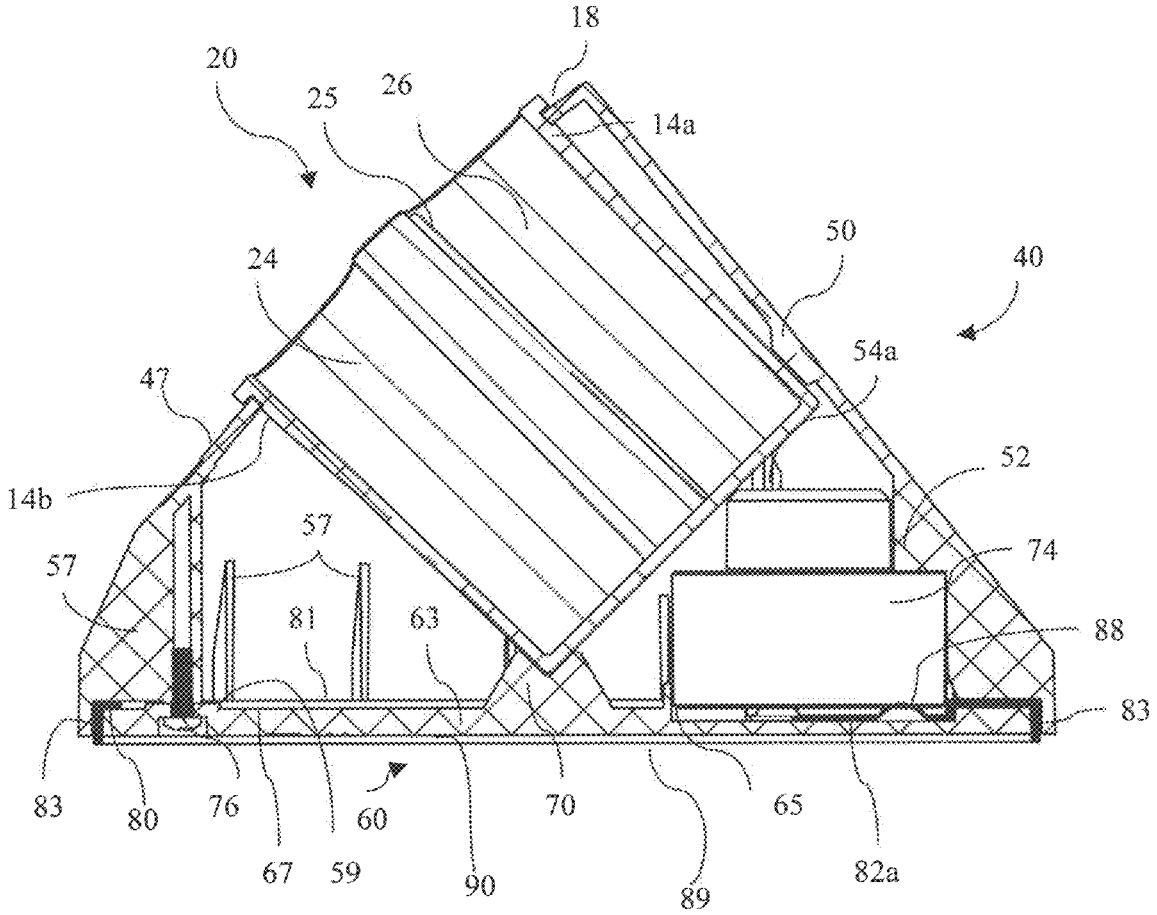
FIG. 14 is a cross sectional view of the holder along section line C-C appearing in FIG. 12 with a counterweight installed.

FIGS. 12, 13 and 14 illustrate an assembled holder 1. The insert 20 has been inserted and connected to stand 40. Stand 40 has been attached to base 60 securing gasket 80 therebetween. FIG. 13 shows the different components assembled together. Insert 20 is received into opening 42 of stand 40 and is stabilized by shoulder 50 and bracket 70. Insert 20 may be removably clipped into stand 40 by wall 47 of the opening 42 acting as a clip 18 to engage slot 16 of insert 20 between wedges 14*a* and 14*b* and flange 12. FIG. 13A shows an enlarged view of clip 18. As a result of the different sized wedges 14*a* and 14*b*, insert 20 may only be inserted into stand 40 in one orientation, namely the orientation where pocket 26 is the top pocket. This ensures that the adjacent heating element rests on rails 25.

Counterweight 74 is preferably located towards the rear of base 60—thus when holder 1 is assembled, counterweight 74 is at the rear of holder 1 while insert 20 is more to the front of holder 1. Counterweight 74 thus stabilizes and counterbalances holder 1 when the straightener is received into pockets 24, 26 of insert 20. Counterweight 74 is preferably comprised of a high density material such as a zinc alloy or steal. It can be a simple puck shape as shown in FIG. 13 or tiered as shown in FIG. 14.

Base 60 may be secured to the stand 40 by threaded screws 76 as discussed above. Upper edge 67 of peripheral wall 63 compresses flange 81 of gasket 80 against the lower edges 59 of stiffening ribs 57 of stand 40 to orient base 60 and gasket 80 within skirt 43 of stand 40. The counterweight 74 may be located and secured in holder 1 by support 65 of the base, arms 82*a*, 82*b* and 82*c* of gasket 80 and by brackets 52, 54*a* and 54*b* of the stand. As mentioned above, bubbles 88 press against the bottom 78 of counterweight 74 to bias the counterweight upwards towards brackets 52, 54*a* and 54*b* to further prevent movement of counterweight 74. Bubbles 88 also compress to account for a counterweight 74 that is slightly larger.

Lower edge 89 of gasket 80 extends below the bottom of base 60 and stand 40 to form surface gripping footing 90.

In use, holder 1 is placed on a counter or other convenient location and the hot ends of the hair straightener or other tool are inserted into respective openings of pockets 24 and 26 to safely hold the tool between periods of use and to allow the tool to cool when finished with.

While different embodiments have been illustrated in the attached drawings and described above, it will be apparent to a person skilled in the art that changes or modifications can be made thereto without departing from the invention. The scope of the claims should not be limited by the embodiments set forth in the examples but should be given the broadest interpretation consistent with the description as a while.

What is claimed is:

1. An apparatus for holding a heatable appliance having at least two heatable elements, comprising:

a stand with at least two pockets, said pockets comprised of a heat resistant material, wherein the at least two pockets each receive a heatable element of a heatable appliance;

a base that may be secured to the bottom of said stand;

a gasket made of a resilient material and having a downwardly extending outer peripheral wall; and wherein said gasket is secured between said base and said stand, and wherein said peripheral wall of said gasket extends below said stand and said base to provide footing.

2. The apparatus of claim 1, wherein said at least two pockets have a gap between them allowing airflow between each pocket.

3. The apparatus of claim 1, wherein at least one of said pockets has at least one extending rail, and wherein said at least one rail limits conductive heat transfer from said appliance to said apparatus.

4. The apparatus of claim 1, wherein said at least two pockets are located in an insert, and wherein said insert can be inserted or removed from said stand.

5. The apparatus of claim 4, wherein said insert is dimensioned to be inserted into said stand unidirectionally.

6. The apparatus of claim 4, wherein said insert is secured to said stand by at least one clip.

7. The apparatus of claim 1, wherein said apparatus further includes a counterweight to balance said apparatus.

8. An apparatus for holding a heatable appliance having at least two heatable elements, comprising a stand;

an insert with at least two pockets, said pockets comprised of a heat resistant material;

a base that may be secured to the bottom of said stand;

a gasket made of a resilient material and having a downwardly extending outer peripheral wall; and wherein the at least two pockets each receive a heatable element of a heatable appliance; and wherein said gasket is secured between said base and said stand, and wherein said peripheral wall of said gasket extends below said stand and said base to provide footing.

9. The apparatus of claim 8 wherein said insert is supported by at least one shoulder in said stand and at least one bracket on said base.

10. The apparatus of claim 8 wherein said stand includes multiple stiffening ribs, and wherein said gasket is secured between said stiffening ribs and said base.

11. The apparatus of claim 8, wherein said apparatus further includes a counterweight to balance said stand.

12. The apparatus of claim 11, wherein said stand includes a plurality of brackets to secure said counterweight.

13. The apparatus of claim 11, wherein said bracket includes a plurality of arms meeting at a single point and each arm having a shoulder to support and secure said counterweight within said apparatus.

14. The apparatus of claim 13, wherein each arm of said bracket includes a plurality of bubbles, and wherein said plurality of bubbles allows for intolerances in the size of the counterweight.

* * * * *